US009743784B2

(12) United States Patent
Piskor

(10) Patent No.: US 9,743,784 B2
(45) Date of Patent: Aug. 29, 2017

(54) DISPLAY UNIT

(71) Applicant: Rare Shopgear Pty Ltd, Cromer (AU)

(72) Inventor: Simon Piskor, Cromer (AU)

( * ) Notice: Subject to any disclaimer, the term of this patent is extended or adjusted under 35 U.S.C. 154(b) by 0 days.

(21) Appl. No.: 14/716,941

(22) Filed: May 20, 2015

(65) Prior Publication Data

US 2015/0335176 A1 Nov. 26, 2015

(51) Int. Cl.

| | |
|---|---|
| ***A47F 5/10*** | (2006.01) |
| ***A47B 43/00*** | (2006.01) |
| ***A47B 45/00*** | (2006.01) |
| ***A47F 5/00*** | (2006.01) |
| ***A47B 87/02*** | (2006.01) |

(52) U.S. Cl.

CPC ..... *A47F 5/108* (2013.01); *A47B 43/00* (2013.01); *A47B 45/00* (2013.01); *A47B 87/0207* (2013.01); *A47F 5/0018* (2013.01); *A47F 5/10* (2013.01)

(58) Field of Classification Search

CPC ..... A47F 5/10; A47F 5/108; A47B 87/0223; A47B 87/0207; A47B 43/00; A47B 45/00

See application file for complete search history.

(56) References Cited

U.S. PATENT DOCUMENTS 866,727 A * 9/1907 Little ..... G09F 5/02 190/17
1,035,552 A * 8/1912 Doerig ..... A47F 7/145 108/99
1,131,128 A * 3/1915 Goodman ..... A47B 51/00 190/17
1,955,769 A * 4/1934 Reynolds ..... G09F 5/02 108/99
2,340,540 A * 2/1944 Lange ..... A47B 61/003 190/11
2,357,819 A * 9/1944 Royden ..... G03B 21/58 160/351
2,483,606 A * 10/1949 Albach ..... A47B 47/03 312/257.1
2,657,810 A * 11/1953 Garrick ..... 108/31
2,791,336 A * 5/1957 Stairwalt ..... A47J 47/16 211/149
2,961,101 A * 11/1960 Hutton ..... A47F 5/108 211/132.1
3,093,247 A * 6/1963 Erickson ..... A47B 31/04 108/188

(Continued)

FOREIGN PATENT DOCUMENTS

CN 2445639 * 9/2001

OTHER PUBLICATIONS

Machine Translation, Description CN 2445639, printed Apr. 14, 2017 from [www.espacenet.com], pp. 1-3.*

*Primary Examiner* — Leslie A Nicholson, III
*Assistant Examiner* — Kimberley S Wright
(74) *Attorney, Agent, or Firm* — Kartsounes Law, LLC

(57) ABSTRACT

A display unit including a plurality of shelves and at least one collapsible support element, wherein the display unit is configured to be moveable between a compact state in which the at least one support element is in a collapsed position, and at least one assembled state in which the plurality of shelves are assembled whereby each assembled shelf is separated by, and supported by the at least one support element in an extended position.

4 Claims, 6 Drawing Sheets

(56) References Cited

Figure 1A:
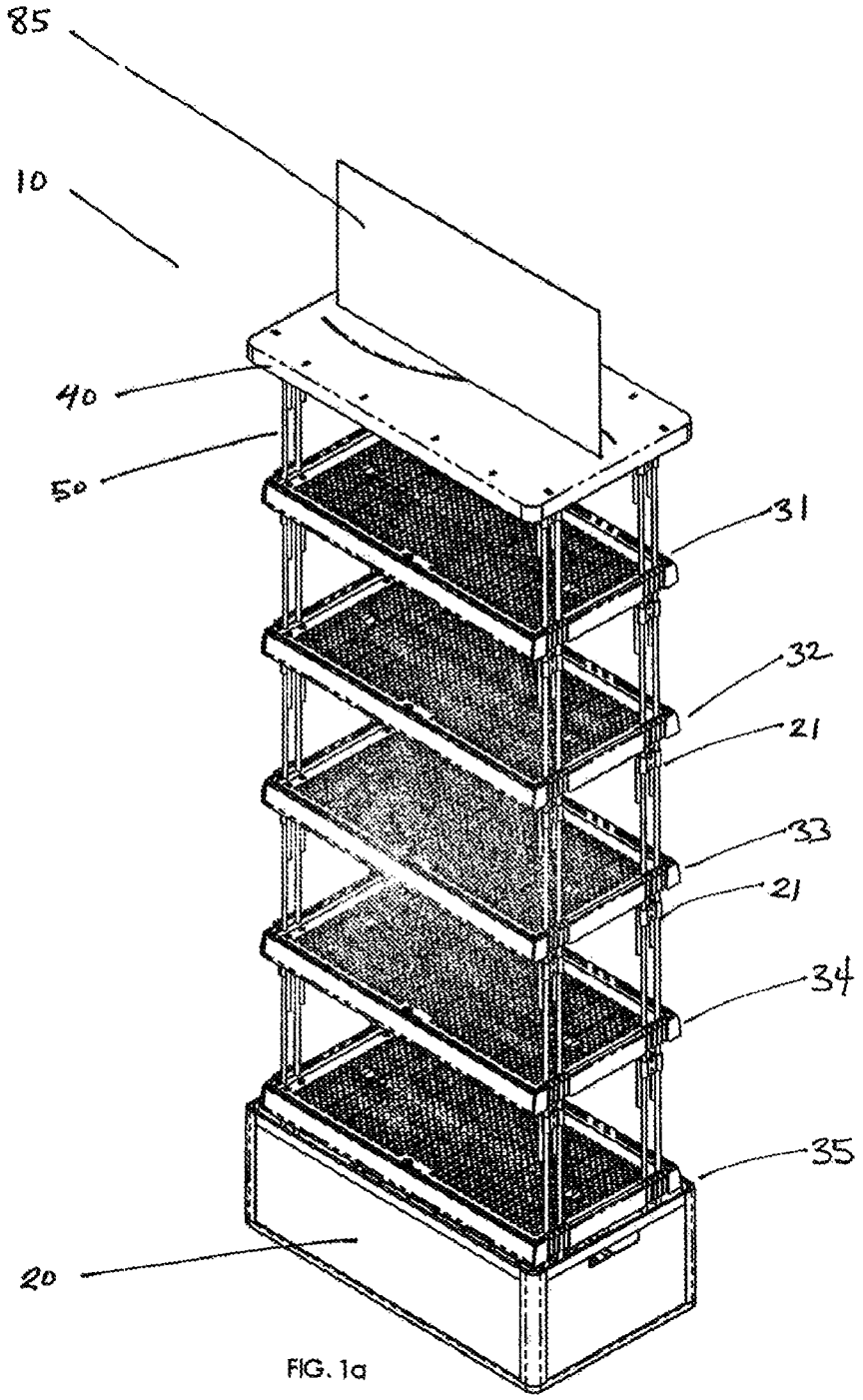

U.S. PATENT DOCUMENTS 3,161,298 A * 12/1964 Naslund ..... A47B 43/00 211/104
3,163,296 A * 12/1964 Hohnstein ..... A47B 43/00 206/511
3,230,962 A * 1/1966 Hoiness ..... A01K 97/22 135/116
4,082,046 A * 4/1978 Baglin ..... 108/106
4,267,905 A * 5/1981 Stewart ..... 190/13 R
4,684,034 A * 8/1987 Ono ..... B65D 7/24 220/1.5
4,691,644 A * 9/1987 Frydman ..... A47B 47/03 108/155
4,747,644 A * 5/1988 Gallery ..... A47B 43/00 312/140
5,004,303 A * 4/1991 Conway ..... A47F 3/004 312/140
5,211,296 A * 5/1993 D'Heygere ..... B65G 1/026 211/1.57
5,238,128 A * 8/1993 Stoddard ..... 211/188
5,372,075 A * 12/1994 Graf ..... 108/180
5,382,087 A * 1/1995 Pouch ..... A47B 73/00 160/135
5,480,225 A * 1/1996 Bailey ..... A47F 3/004 312/114
5,590,796 A * 1/1997 Herman ..... A47F 5/108 108/99
6,123,207 A * 9/2000 Mast ..... A47B 43/00 211/149
6,321,921 B1 * 11/2001 Massoudnia ..... A47F 5/10 108/125
6,382,435 B1 * 5/2002 Legaz ..... B62B 3/006 211/149
6,969,132 B1 * 11/2005 Viville ..... A47B 31/02 211/1.3
D533,735 S * 12/2006 Carlsson ..... D6/682.2
D537,276 S * 2/2007 Kelman ..... D6/675.4
7,334,669 B2 * 2/2008 Barker et al. ..... 190/104
7,624,900 B2 * 12/2009 McLaughlin ..... 223/85
8,256,630 B2 * 9/2012 Zhu ..... A47B 31/04 211/149
8,342,347 B2 * 1/2013 Hay ..... B65D 11/1866 16/352
8,453,854 B2 * 6/2013 Baran ..... A47F 5/10 211/149
8,672,147 B2 * 3/2014 Lam ..... A47G 25/0685 211/149
8,998,011 B2 * 4/2015 Zhu ..... A47B 43/04 211/201
9,198,508 B1 * 12/2015 Kufel ..... A47F 5/116
9,492,009 B2 * 11/2016 Naka ..... A47B 47/0091
2005/0121275 A1 * 6/2005 Platte, III ..... A45C 5/14 190/103
2005/0126872 A1 * 6/2005 Dror ..... A45C 9/00 190/107
2006/0000681 A1 * 1/2006 Barker et al. ..... 190/18 A
2006/0096821 A1 * 5/2006 McKaba ..... 190/9
2006/0118460 A1 * 6/2006 McKenzie ..... A47F 5/10 206/748
2007/0131633 A1 * 6/2007 Ferm ..... A47B 43/00 211/149
2008/0142322 A1 * 6/2008 Barker et al. ..... 190/104
2010/0117499 A1 * 5/2010 Fortier ..... A45C 7/0031 312/306
2011/0084069 A1 * 4/2011 Hay ..... B65D 11/1866 220/4.28
2015/0041420 A1 * 2/2015 Zelek ..... A47B 43/00 211/149
2015/0289641 A1 * 10/2015 Ergun ..... A47B 9/16 108/42
2016/0015172 A1 * 1/2016 Zelek ..... A47F 5/10 211/149

* cited by examiner

DISPLAY UNIT

FIELD OF THE INVENTION

This invention broadly relates to a collapsible shelving unit for the display or presentation of products or other items.

BACKGROUND OF THE INVENTION

In the economic activities of advertising, marketing and sales, the placement and presentation of products and/or information relating to products or services offered for sale is all important.

Traditionally, items for sale in a shopfront window are positioned on shelves, stands or other units in order maximise the range and visual impact of items displayed to the passer-by. The same principle applies to portable units for displaying products or information, such as temporary stands used in exhibition halls, 'pop-up' stands set up in commercial centres or portable displays used by travelling salespersons. However, portable display units need to be both easy to set up and dismantle, and versatile to allow for marketing, sales and advertising activities to be adjusted to suit the environment in which the display unit is placed.

There is therefore a need for a display unit which offers enhanced portability and versatility.

Portable display units in the past have incorporated hinged foldable parts which, when packed up, can be carried around by an individual. Many such prior display units have complicated assembly processes, and setting up can be time consuming. Prior portable display units may also have a single assembled state, and this can restrict the versatility of the display unit to accommodate items of differing size or number.

Such proposals may be contrasted with the invention presently disclosed in that the invention uses a simple assembly process and provides a range of display options for the user.

The above references to and descriptions of prior proposals or products are not intended to be and are not to be construed as, statements or admissions of common general knowledge in the art. In particular, the above discussion does not relate to what is commonly or well known by the person skilled in the art, but assists in the understanding of the inventive step of the present invention of which the identification of pertinent prior art proposals is but one part.

SUMMARY OF THE INVENTION

Orientational terms used in this specification and terms such as base, lid, upper and lower, are to be interpreted as relational and are used on the understanding that the component, item, article, or instrument will usually be considered in a particular orientation, typically with the base of the display case located on a surface and, in an assembled state, the shelves located directly above the base.

According to a first aspect of the present invention, there is provided a display unit including a plurality of shelves and at least one collapsible support element; the display unit is adapted to be moveable between a compact state and at least one assembled state, the collapsible support element(s) each adapted to be movable between a collapsed position and at least one extended position; wherein in the compact state the support element(s) are in a collapsed position; and in an assembled state a plurality of shelves are assembled whereby each assembled shelf is separated by, and supported by, the at least one support element(s) in an extended position.

Preferably, the display unit further includes a display unit case wherein the support element(s) and shelves fit into the display unit case when the display unit is in the compact state. In this configuration, the portability of the display unit is increased.

The display unit case may also be configured such that in the compact state, the shelves and support element(s) are located wholly within the boundary of the display unit case. Alternatively, parts of the shelves and/or support element(s) may be located outside of the display unit in the compact state.

Preferably, in the assembled state, the display unit case constitutes the base of the display unit, making it stable and enabling it to stand securely by itself. Alternatively, some other part of the display unit may operate to make the display unit stable, or the display unit may be used in conjunction with another structure to make it stable.

Preferably, the display unit includes a lid which is supported by one or more support element(s) in the assembled state. The lid may fold back, slide or otherwise move to enable the shelves to be assembled.

Preferably a plurality of support elements are used, each support element being a rigid straight bar having a certain length, each bar's upper end being located closest to the lid or top of the display case and each bar's lower end being located closest to the base when the display unit is in the assembled state. Preferably, the rigid bars collapse by pivoting or sliding along rails located in or on the shelves. Alternatively, the support element(s) may incorporate a telescoping mechanism in which a series of cylindrical sub-elements collapse into each other (each sub-element smaller in diameter than the next outer sub-element), or another mechanism which allows the support element(s) to collapse as well as to extend to support the shelves in the assembled state.

The shelves of the display unit are preferably rectangular in dimension. Alternatively, they may take a circular, triangular or other shape. Where rectangular shelves and rigid bars for support elements are used, the bars preferably slide along rails located along the long side of the shelves.

Preferably, in the extended position the support element (s) are located at the corners of a shelf, though not necessarily at each corner. The support element(s) may also be located elsewhere, such as at the centre region of a shelf.

The support element(s) may travel through the shelves. In this case, the preferred mechanism for the collapsing support element(s) is a telescoping mechanism as described above.

Preferably, one or more support elements are adapted to provide multiple collapsed positions, so that the space between each assembled shelf can be adjusted, and different assembled states can be realised. In this case, where a telescoping support element is used, it may have a plurality of extended positions. Preferably, the plurality of extended positions are each realised by operation of spring loaded sub-element which cooperates with a series of holes located on the circumference of a plurality of interoperating cylindrical sub-elements. Alternatively, multiple collapsed positions may be realised by the use of rigid bars as support elements adapted to slide on rails located along the sides of shelves, or on the top-side and/or under-side of shelves; the rails preferably including stoppers or other cooperating sub-elements which permit the bars to be secured at a variety of positions along the rails, thereby permitting variable spacing between the shelves. A combination of telescoping support elements and rails may also be used to permit greater versatility in the shape of the assembled display unit.

Preferably, so as to move the display unit from the compact state to the assembled state, the user need simply pull the lid or top shelf of the unit upwards to move the support element(s) into an extended position, and the shelves into an assembled position. It is contemplated that the support element(s) may incorporate, or operate in conjunction with, a spring, piston or other device such to assist in automating the assembly of the display unit from the compact state to the assembled state. The spring, piston or other device preferably assists in raising a shelf into an assembled position by pushing against the base, or against a lower shelf of the display unit.

According to a second aspect of the invention there is provided a display unit in accordance with the first aspect of the invention, the display unit adapted to be movable between a compact state and a plurality of assembled states, wherein in each assembled state a plurality of spaced shelves are assembled.

In a preferred configuration, the each assembled state of the display unit differs from the other by the number of display shelves which are formed in each respective assembled state. For example, in a first assembled state, three shelves are formed (excluding the display case lid) and in a second assembled state, four shelves are formed.

According to a third aspect of the present invention, there is provided a display unit in accordance with the first or second aspect of the invention, the display unit further including interchangeable panels. The interchangeable panels are adapted to allow advertising, print material, or similar to be interchangeably placed under or on the panel, thereby further increasing the versatility of the display unit.

Preferably, the panels are located on the sides of the shelves and the sides of the display unit case. The panels may extend beyond the dimensions of the shelves and/or display unit case. In a preferred configuration, the lid is adapted to support an upper message for advertising.

In a preferred embodiment the display unit includes locking means for vertically aligning and securing the shelves in the assembled state. The locking means may be a pin slidable along the support member and engagable with the shelf.

It is to be understood that any or all of the three aspects of the invention may be combined in any combination.

BRIEF DESCRIPTION OF THE INVENTION

Figure 1B:
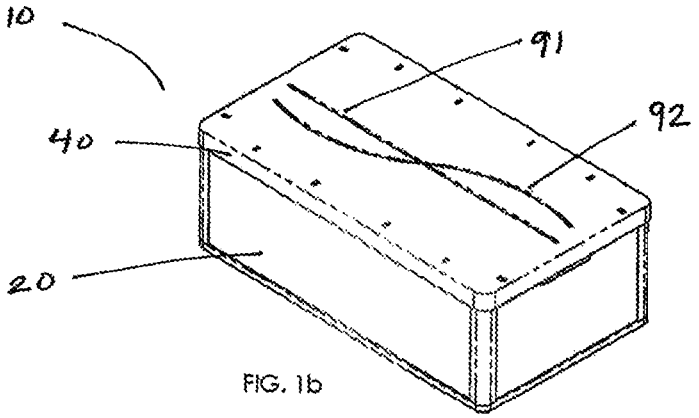
Figure 1C:
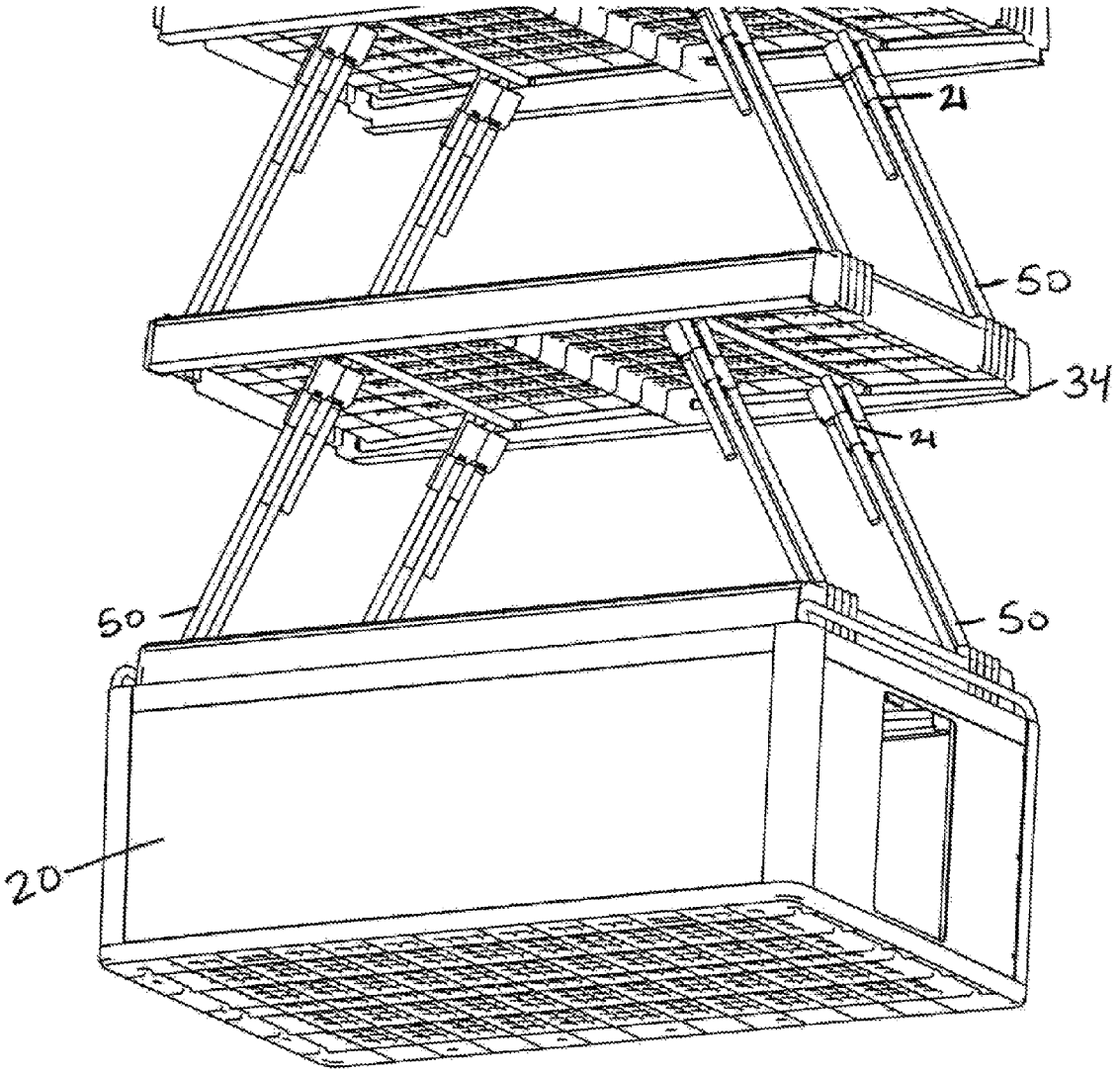

Possible and preferred features of the present invention will now be described with particular reference to the accompanying drawings. However, it is to be understood that the features illustrated in and described with reference to the drawings are not to be construed as limiting on the scope of the invention. In the drawings:

FIG. 1*a* is a perspective view of a display unit according to the first aspect of the present invention, depicted in an assembled state;

FIG. 1*b* is the display unit represented in FIG. 1*a*, depicted in a compact state;

FIG. 1*c* is the display unit represented in FIG. 1*a*, depicted in a state wherein the pins are slidable along the at least one support element.

Figure 2A:
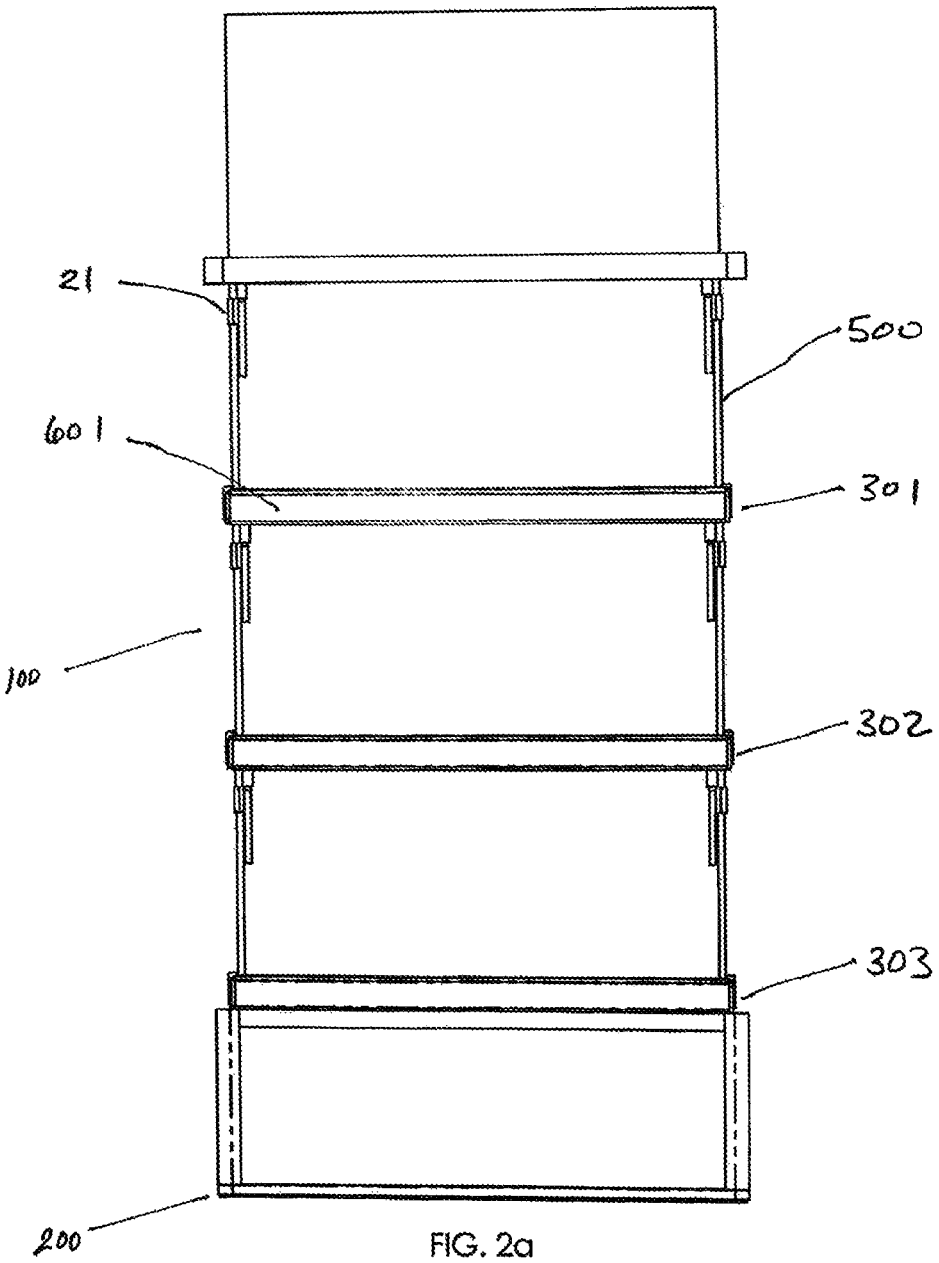
Figure 2B:
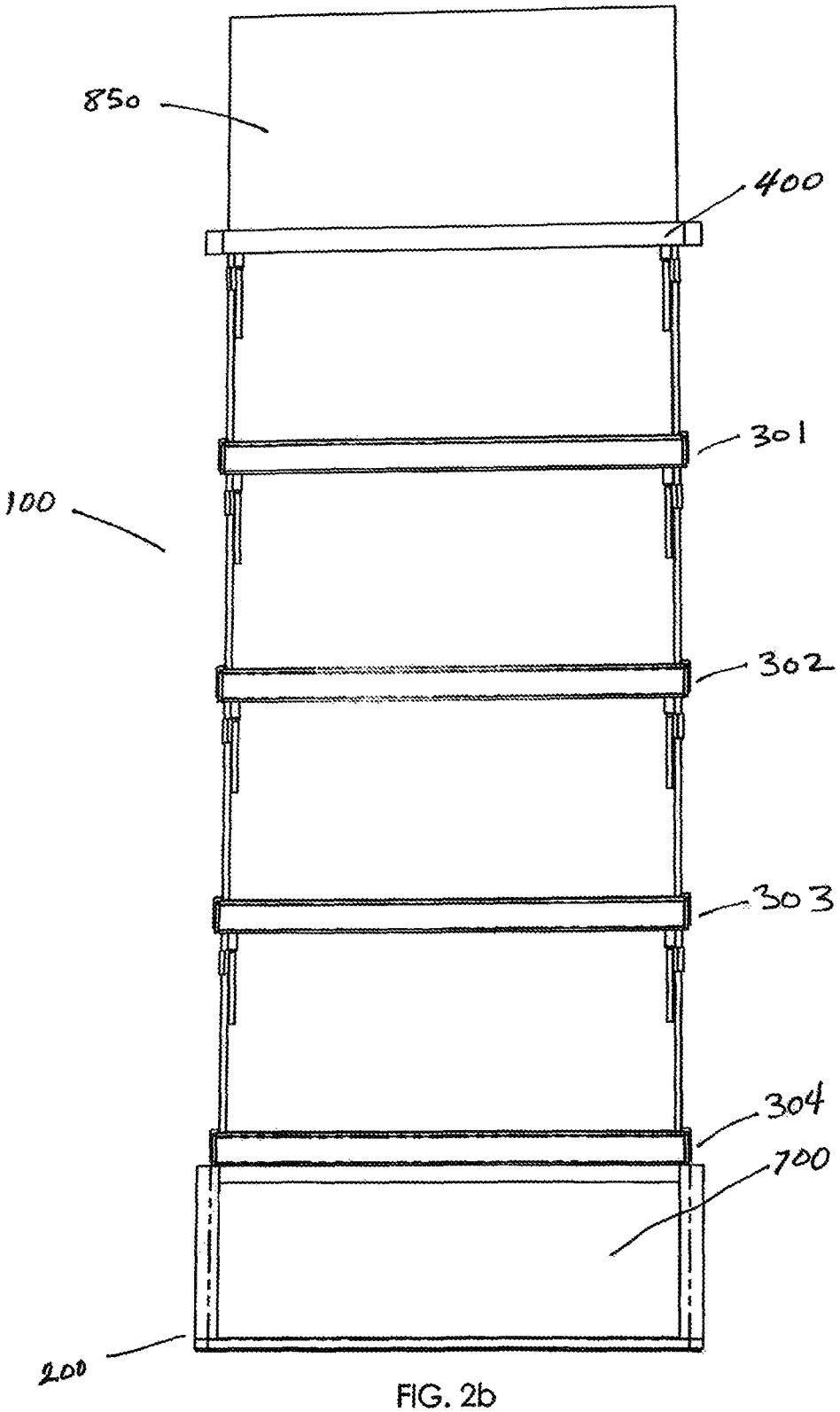
Figure 2C:
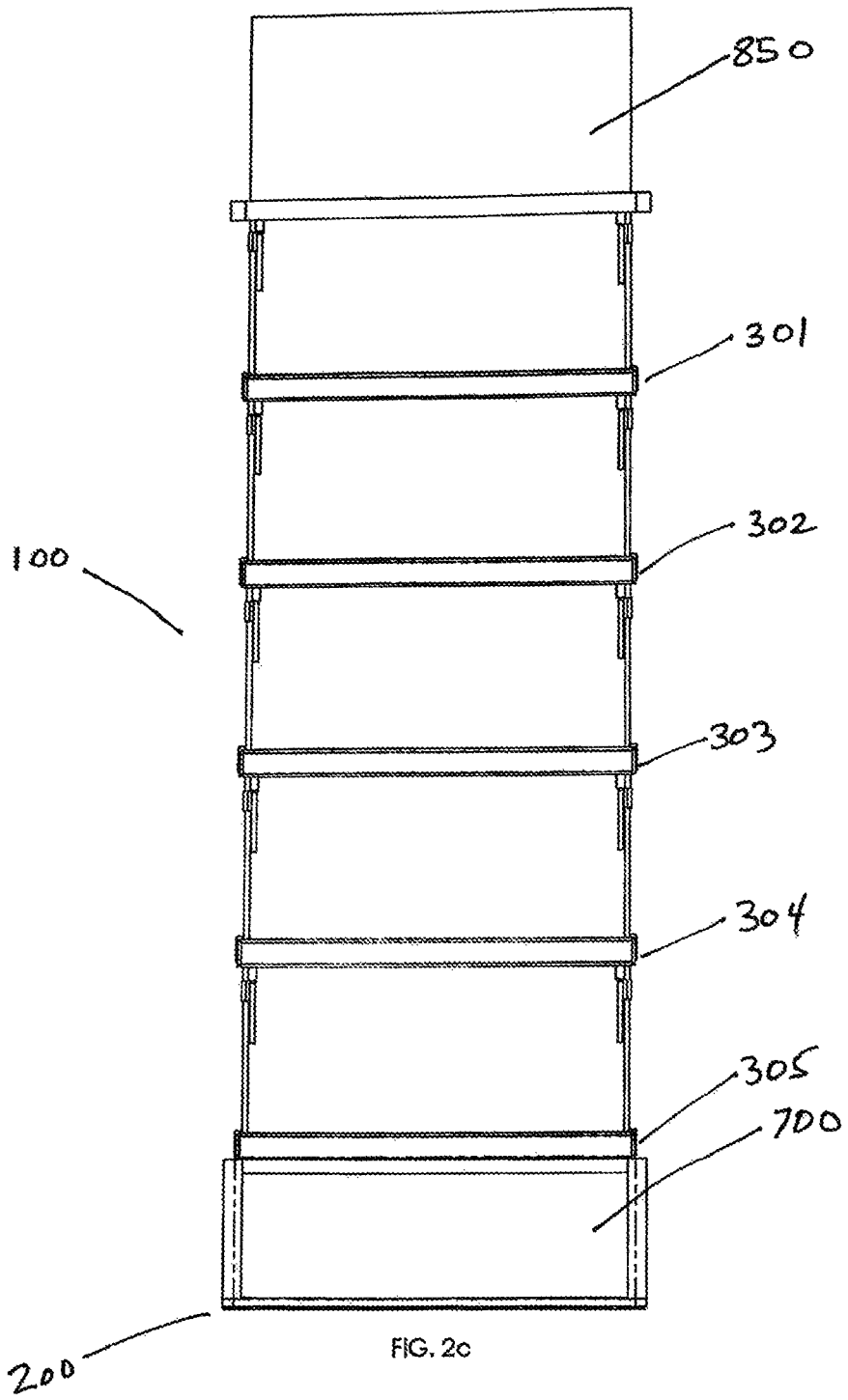

FIG. 2*a* is a front view of a display unit according to the second aspect of the invention, depicted in a first assembled state and having three shelves; FIG. 2*b* is a front view of the display unit represented in FIG. 2*a*, depicted in a second assembled state and having four shelves; and FIG. 2*c* is a front view of the display unit in FIG. 2*a*, depicted in a third assembled state and having five shelves.

DETAILED DESCRIPTION OF EMBODIMENTS

In FIG. 1*a*, an embodiment of a display unit 10 according to the first aspect of the invention is depicted in an assembled state, whereas in FIG. 1*b*, the display unit 10 is depicted in a compact state. In FIG. 1*a*, the display unit 10 has a display unit case 20 and a series of five rectangular shelves (31 to 35), and a lid 40. The display unit case 20 constitutes a support base for the display unit 10 in this embodiment. Sets of two slidable parallel bars 50 (only one set is labelled on FIG. 1*a*), located in each corner of each rectangular shelf 30 are the support elements which separate one shelf from another in the assembled state. The slidable parallel bars 50 are slidable along rails (not shown), the top end of each bar being slidably movable along a corresponding rail located along each long side of each rectangular shelf (or the lid), each bar 50 being able to pivot at its lower end. When the display unit 10 is in a compact state as depicted in FIG. 1*b*, the upper parts of each of the bars 50 collapse inwardly to be parallel to a shelf. Locking pins 21 (labelled on FIG. 1*a*) are slidable along the parallel bars 50 to securely align the shelves 31-35 vertically.

In order to assemble the display unit 10 in FIG. 1*a*, starting with the display unit in the compact state as depicted in FIG. 1*b*, the assembler raises the lid 40 upwards thereby separating the lid 40 from the first or upper shelf 31; during the process of raising the lid 40, the support elements collapsibly attached to the upper shelf 31, move from a collapsed position into an extended position to support the lid 40 above the first or upper shelf 31;

next, the upper shelf 31 is raised by the assembler upwards to separate the upper shelf 31 from the second shelf 32 and the support elements 50 attached to the second shelf move from a collapsed position into an extended position to support the lid 40 and the upper shelf 31 above the second shelf 32. The raising of the upper shelf 31 from the second shelf 32 is achieved in this case by the lid 40 moving upwards, which in turn raises the upper shelf 31 and second shelf 32, or alternatively, by raising the second shelf 32 which thereby raises the assembled upper shelf 31; the remaining shelves are likewise assembled until each of the third shelf 33, fourth shelf 34 and fifth shelf 35 are moved into position so that the display unit 10 is in the assembled state as depicted in FIG. 1*a*.

FIGS. 1*a* and 1*b* also depict a display unit lid 40 having two recesses, one recess being parallel to the long sides of the rectangular lid 91 (not visible in FIG. 1*a*), the other recess being curved 92. Each recess 91, 92 is capable of receiving an upper message 85. The parallel recess 91 receives the upper message 85 in each of FIGS. 1*a* and 1*b*.

In FIGS. 2*a*, 2*b* and 2*c*, an embodiment of a display unit 100 according to a second aspect of the invention is depicted. The display unit 100 in FIGS. 2*a*, 2*b* and 2*c* has a display unit case 200 and a series of rectangular shelves 301-305, and a lid 40. The display unit case 200 constitutes a support base for the display unit in this embodiment. Support bars 500 (only one of which is labelled, see FIG. 2*a*), located in each corner of each rectangular shelf 301-4, are the support elements which separate one shelf from another in the assembled state. In FIG. 2*a*, the display unit 100 is in an assembled state having three shelves 301-303; and in FIG. 2*b* the display unit 100 is in an assembled state having four shelves 301-304.

In FIGS. 2*a* and 2*b*, on the front side of each rectangular shelf 300 there is an interchangeable shelf panel under which is positioned a shelf message strip. The front face of the interchangeable shelf panel is slidable relative to the shelf which permits the shelf message strip to be interchanged as needed. Only the shelf panel 601 and message strip 651 for the upper shelf 301 is labelled in FIG. 2*a*. Similarly, the four faces of the display unit case 200 (only the front face is shown) each have an interchangeable case panel 700 which permits the case message to be interchanged, which is labelled in FIG. 2*b* only.

In FIGS. 2*a* and 2*b*, an interchangeable upper message 850 is depicted above the lid 400, and this is labelled in FIG. 2*b* only. The interchangeable upper message 850 is removably attached to the lid 400. In the aforementioned embodiments the lid 400 has recesses to receive the upper message 850, which has been described above with reference to FIG. 1*b*.

Advantages of the display unit herein described are many. First, the portability of the display unit: it can be carried from display location to location in a compact state by means of the display unit case. The case may be fitted with handles, grips, knobs or similar means to permit easy carrying of the unit. Second, as depicted in FIGS. 1*a*, 1*b* and 2*a* and 2*b*, the display unit 10, 100 is free-standing and supported by its display unit case 20, 200, so no additional support structures at the base are required in order to set up the display unit. This increases the range of locations where the display unit 10, 100 can be used. Third, the unit 100 is simple and fast to assemble. The limited number of parts, and self-contained nature of the design, further enhances its portability.

With reference to the embodiment of the display unit depicted in FIGS. 2*a* and 2*b*, this is a highly versatile display unit 100 which provides the added flexibility of having a plurality of assembled states and allows the display unit 100 to be used in a larger variety of spaces and for a wider variety of display purposes. Furthermore, the interchangeable panels 600 and interchangeable upper message 850 provide further advantages in customising the display unit 100 to suit the needs of the user.

The shelves 31-35,301-305 and lids 40,400 of the display units 10,100 in FIGS. 1*a*, 1*b* and 2*a*, 2*b* and 2*c* are made out of acrylonitrile butadiene styrene (ABS); suitable alternative materials may include other polymers and copolymers, polyvinyl chloride (PVC), metals such as steel and composite metal-plastic materials. The case of the display units 20, 200 is made from ABS with corners made out of PVC, however the materials used for the case may be made from other materials such as other polymers and copolymers, metals and metal-plastic composites. The support structure, including the support elements 50, 500 and rails (not shown), is made from mild steel but may be made from other suitable materials including polymers and copolymers, and metal-plastic composites.

It will be appreciated by those skilled in the art that many modifications and variations may be made to the embodiments described herein without departing from the spirit or scope of the invention.

The invention claimed is:

1. A display unit including:

a base;

a series of shelves;

a plurality of collapsible support elements, each support element attaching between an adjacent pair of shelves within the series of shelves by sliding attachment at one end of a support element and by pivotal attachment at the opposite end of a support element wherein the display unit is configured to be moveable between a compact state in which the support elements are in a collapsed position and an assembled state in which at least some of the adjacent pairs of shelves within the series of shelves are parallel and spaced apart from each other by the support elements configured in the extended position; and one or more locking pins slidable along the support elements for locking each of the plurality of shelves in place in the assembled state;

wherein the base includes a case configured to house the support elements and the plurality of shelves in the compact state, and wherein one of the plurality of shelves forms a lid on the case when the display unit is in the compact state.

2. The display unit of claim 1, wherein the lid is movable to facilitate assembly of the shelves.

3. The display unit of claim 1, wherein the assembled state includes a plurality of assembled states, and in each assembled state the plurality of shelves are spaced apart and supported by the support elements.

4. The display unit of claim 3, wherein the each assembled state includes a respective number of shelves.

* * * * *